US006842934B1

(12) United States Patent
McKay, Jr. et al.

(10) Patent No.: US 6,842,934 B1
(45) Date of Patent: Jan. 18, 2005

(54) ADHESIVE ROLLER

(75) Inventors: Nicholas D. McKay, Jr., Atlanta, GA (US); Mark Schmidt, Evans, GA (US)

(73) Assignee: The Evercare Company, Alpharetta, GA (US)

( * ) Notice: Subject to any disclaimer, the term of this patent is extended or adjusted under 35 U.S.C. 154(b) by 0 days.

(21) Appl. No.: 10/688,160

(22) Filed: Oct. 17, 2003

(51) Int. Cl.[7] ..... A47L 25/00
(52) U.S. Cl. ..... 15/104.002; 428/124; 428/126
(58) Field of Search ..... 15/104.002; 428/40.1, 428/124, 126, 194

(56) References Cited

U.S. PATENT DOCUMENTS 2,191,704 A * 2/1940 Bennett ..... 156/230
2,800,215 A * 7/1957 Converse ..... 400/702
2,852,423 A * 9/1958 Bassett, Jr. ..... 428/189
4,905,337 A 3/1990 McKay
5,388,300 A * 2/1995 Hickey ..... 15/104.2
2003/0096074 A1 * 5/2003 Kim ..... 428/40.1

* cited by examiner

*Primary Examiner*—Randall Chin
(74) *Attorney, Agent, or Firm*—Gifford, Krass, Groh, Sprinkle, Anderson & Citkowski, P.C.

(57) ABSTRACT

An adhesive roller construction for detritus removal having an elongated strip. The elongated strip includes a backing layer and an adhesive layer overlying and covering one side of the backing layer. The other side of the backing layer has an adhesive release surface. The strip includes a first end, a second and two spaced-apart side edges. A portion of at least one side edge of the strip is retrorsely folded over and adhesively attached to the adhesively coated side of the strip. The strip is then wound from one end to the other end into a cylindrical roll with the adhesive layer facing outwardly.

8 Claims, 2 Drawing Sheets

ADHESIVE ROLLER

BACKGROUND OF THE INVENTION

I. Field of the Invention

The present invention relates generally to adhesive rollers of the type used for detritus removal.

II. Description of Related Art

There are many previously known adhesive rollers for detritus removal. These previously known rollers typically comprise an elongated strip having a backing layer. The strip includes two ends and two spaced-apart and parallel side edges.

An adhesive layer is provided along a first side of the backing layer. Thereafter, the strip is wound into a tubular and cylindrical roll with the adhesive layer facing outwardly. Oftentimes the strip is wound about a tubular core and the tubular core is then rotatably mounted on a handle to facilitate rolling of the adhesive roller along the surface desired to be cleaned.

After prolonged use of the adhesive roller for cleaning surfaces, the adhesive on the outermost layer or sheet of the adhesive roller becomes covered with detritus and other matter and loses its adhesiveness. When this happens, it is necessary to remove the outermost sheet of the adhesive roller to expose fresh adhesive on the next underlying sheet of the roller.

The second side of the backing layer, i.e. the side of the backing layer opposite from the adhesively coated side, is either coated with an adhesive release coating or has inherent release characteristics so that the surface reduces, but does not eliminate, the adhesion of the second side of the backing strip with the adhesive coating on the next underlying sheet. Such adhesion, of course, is necessary in order to maintain the integrity of the roller in use.

Consequently, because of the adhesion of the backing layer with the adhesive on the next underlying layer of the roller, the actual removal of individual sheets, each constituting one circumference of the roller, is difficult to achieve without tearing or shredding the sheet being removed. Furthermore, in the event that the entire first surface of the backing layer was covered with the adhesive, it is very difficult to initiate the removal of individual sheets since the edge of the sheet must be peeled away from the underlying sheet before the user is able to grab the outermost sheet and remove it from the roll.

There have, however, been a number of previously known adhesive roller constructions which are designed to facilitate the removal of individual sheets from the roller to expose fresh adhesive on the next underlying sheet. In one previously known adhesive roller, in order to facilitate the initiation of the removal of an individual sheet from the roller, the adhesive roller is provided with at least one and often two "dry" edges along the first side of the backing layer. These dry edges are uncovered with adhesive so that the edge of the outermost sheet can be easily grasped along the dry edge in order to initiate the removal of the outermost sheet from the roller.

In order to form the dry edges along one or both sides of the backing layer, it has been previously necessary to zone coat the adhesive coating on the first side of the backing layer. Furthermore, for aesthetic reasons, it is necessary to maintain a dry edge of relatively uniform width along the entire backing layer. Without a dry edge of relatively uniform width, such adhesive rollers are commercially unacceptable.

A primary disadvantage of these previously known a dhesive rollers, however, is that the zone coating of the adhesive to form the uniform width dry edges significantly increases the manufacturing cost for the adhesive roller.

SUMMARY OF THE PRESENT INVENTION

The present invention provides an adhesive roller which overcomes all of the above-mentioned disadvantages of the previously known adhesive rollers.

In brief, the adhesive roller of the present invention comprises an elongated strip having a backing layer constructed of any conventional material, such as film, paper, cloth, foam and the like. The strip has a first end, a second end and two spaced-apart side edges.

An adhesive layer then overlies and covers one side of the backing layer. The adhesive layer can be applied by flood coating which is a less expensive manufacturing process than zone coating.

The other side of the backing layer has an adhesive release surface which minimizes, but does not eliminate, adhesion between the other side of the backing layer and the adhesive. The adhesive release surface of the other side of the backing layer may be formed by applying an adhesive release coating to the other side of the backing layer or, alternatively, may be due to the inherent release characteristics of the backing layer material.

A portion of at least one side edge of the strip is then retrorsely folded over and adhesively attached to the adhesively coated side of the strip. The strip is then wound from one end and to its other end into a cylindrical roll with the adhesive layer facing outwardly.

Since the adhesive release surface of the folded-over portion of the strip faces outwardly and abuts against the adhesive release surface of the next outermost sheet of the roll, the folded-over portion of the strip does not adhere to the adhesive roll. As such, the folded-over portion may be easily grasped by the user when removal of an individual sheet from the roll is desired.

Additionally, in the conventional fashion, laterally extending perforations or a cut are formed along the strip at spaced intervals corresponding to one revolution of the strip around the roll to facilitate the removal of individual sheets from the roll.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
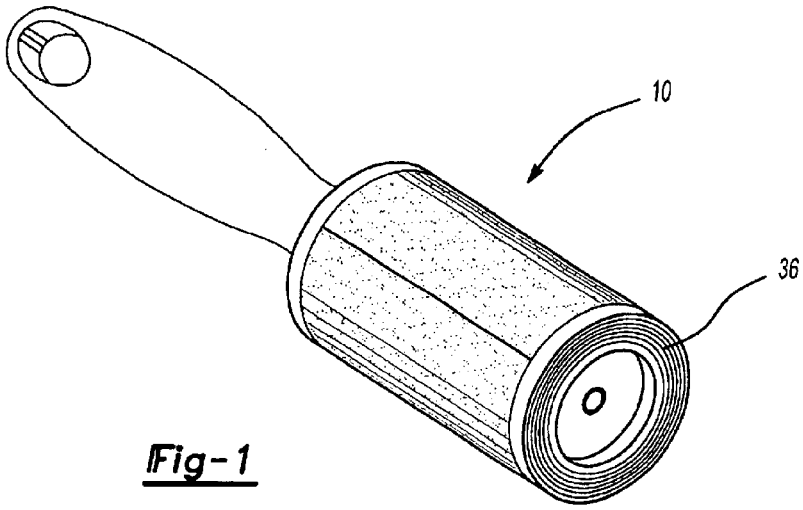
FIG. 1 is an elevational view illustrating a preferred embodiment of the present invention.

With reference to the drawing, a preferred embodiment of the adhesive roller 10 of the present invention is shown and comprises an elongated strip 12. The strip 12 has a first end 14, a second end 16 and two spaced-part and parallel side edges 18.

Figure 2:
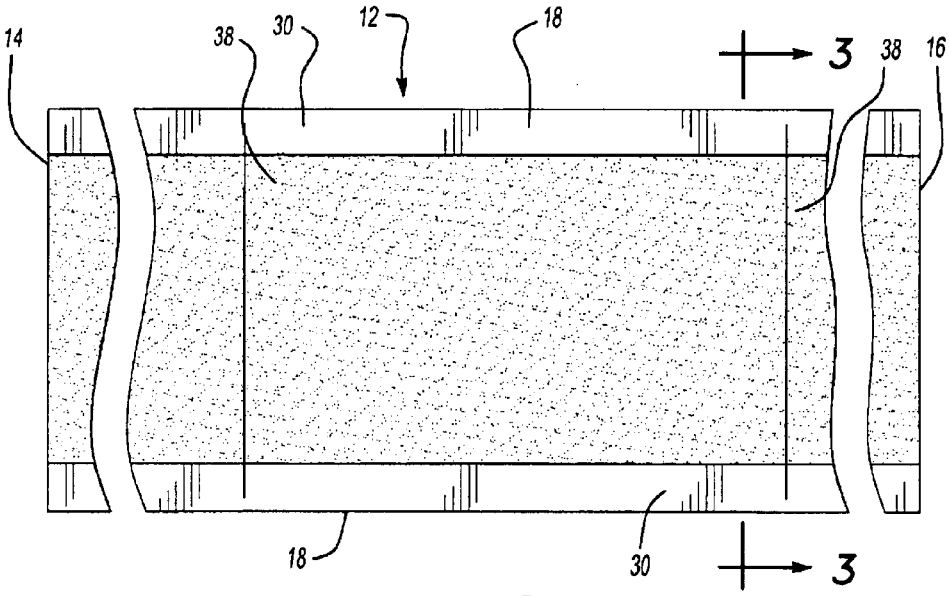
FIG. 2 is a plan view of a portion of the preferred embodiment of the present invention.
Figure 3:
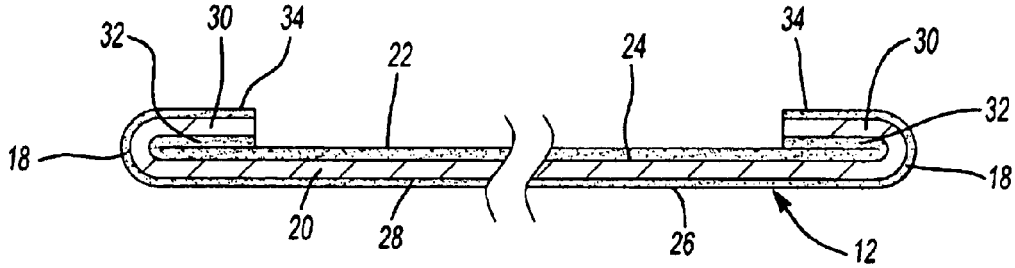
FIG. 3 is a sectional view taken substantially a long line 3—3 and enlarged f or clarity.

As best shown in FIGS. 2 and 3, the strip 12 comprises an elongated backing layer 20. The backing layer 20 may be constructed of any conventional material, such as paper, film, plastic, foam, cloth and the like.

An adhesive layer 22 is then applied to a first side 24 of the backing layer 20 so that the adhesive layer 22 substantially covers the entire side 24 of the backing layer 20. Any conventional manufacturing process, such as flood coating, can be used to apply the adhesive layer 22 to the side 24 of the backing layer 20.

As best shown in FIG. 3, an adhesive release layer 26 is then applied to the opposite or second side 28 of the backing layer 20 so that the adhesive release layer 26 substantially covers the entire side 28 of the backing layer 20. Any con vent ional manufacturing process, such as flood coating, can be used to apply the adhesive release layer 26, such as silicone, to the backing layer 20. Furthermore, the adhesive release layer 26 reduces, but does not eliminate, adhesion between the adhesive release layer 26 and the adhesive layer 22 for a reason to be subsequently described.

Although preferably an adhesive release coating 26 is applied to the second side 28 of the backing layer 20 so that the second side 28 of the backing layer 20 exhibits an adhesive release surface, alternatively an adhesive release surface may be obtained from the second side 28 of the backing layer 20 from the inherent adhesive release characteristics of the backing layer material. For example, if the backing layer 20 is constructed from a film material, the film material may exhibit sufficient adhesive release characteristics such that the application of an adhesive release layer 26 is unnecessary.

Still referring to FIGS. 2 and 3, a portion 30 of at least one, and preferably both side edges 18 of the strip 12 is retrorsely folded over the side 24 of the backing layer 20. In doing so, the adhesive layer 32 of each portion 30 contacts and is adhesively secured to the adhesive layer 22. Simultaneously, an adhesive release surface 34 of each folded-over portion 30 of the strip 12 is provided along each side of the remaining exposed adhesive layer 22 of the strip 12.

Figure 4:
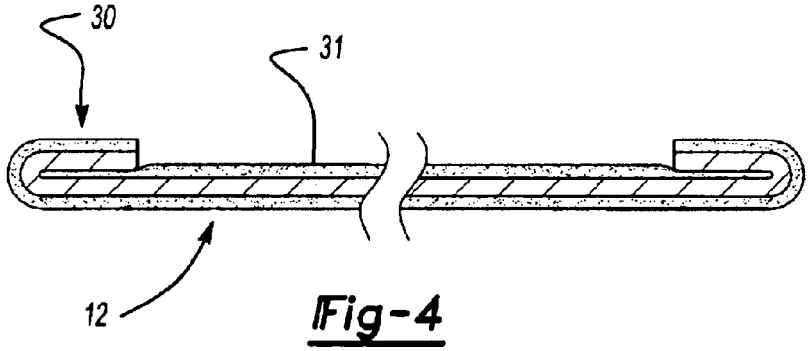
FIG. 4 is a view similar to FIG. 3, but illustrating a modification thereof.

With reference to FIG. 4, optionally the folded-over portions 30 of the strip 12 are compressed so that the folded-over portions 30 have substantially the same thickness as a central portion of the strip 12. Any conventional means, such as a compression roller, may be used to compress the portions 30 of the strip.

With reference now to FIG. 1, the strip 12 is then wound from one end 14 and to its second end 16 into a cylindrical roller 36 with the adhesive layer 22 facing outwardly. In doing so, the adhesive release surface 34 of each folded-over portion 30 abuts against, and does not adhere to the adhesive release surface 26 of the next outermost layer of the roller 36. As such, the portions 30 may be easily manually gripped when removal of individual sheets, each corresponding to one revolution of the roller 36, is desired. Additionally, conventional perforations 38 (FIG. 2) or a cut are formed through the strip at spaced intervals therealong corresponding to one revolution of the strip 12 around the roll 36 in the conventional fashion.

From the foregoing, it can be seen that the present invention provides an adhesive roller in which one or both sides of the strip can be easily manually grasped for individual sheet removal from the roll. Furthermore, since the adhesive layer and, optionally, the adhesive release layer may be applied to the backing layer by inexpensive manufacturing processes, such as flood coating, the adhesive roller construction 10 can be inexpensively manufactured.

Having described my invention, however, many modifications thereto will become apparent to those skilled in the art to which it pertains without deviation from the spirit of the invention as defined by the scope of the appended claims.

We claim:

1. A roller construction for detritus removal comprising:

an elongated strip, said strip having a backing layer and an adhesive layer overlying and covering one side of said backing layer, said strip having a first end, a second end and two spaced-apart side edges, the other side of said backing having an adhesive release surface, a portion of at least one side edge of said strip being retrorsely folded over and adhesively attached to said one side of said strip, wherein said strip is wound from one end to the other end into a cylindrical roll with said adhesive layer facing outwardly.

2. The invention as defined in claim 1 and comprising an adhesive release coating overlying said other side of said backing layer.

3. The invention as defined in claim 2 wherein said adhesive release coating comprises silicone.

4. The invention as defined in claim 1 wherein both side edges of said strip are retrorsely folded over and adhesively secured to said one side of said strip.

5. The invention as defined in claim 1 wherein said backing layer comprises paper.

6. The invention as defined in claim 1 wherein said backing layer comprises a film.

7. The invention as defined in claim 1 wherein said backing layer comprises cloth.

8. The invention as defined in claim 1 wherein said portion of said strip is compressed substantially to the thickness of a central portion of said strip.

* * * * *